US005769005A

United States Patent [19]

Haynes

[11] Patent Number: 5,769,005

[45] Date of Patent: Jun. 23, 1998

[54] ADJUSTABLE LENGTH TABLE LEG FOR A MASSAGE TABLE

[76] Inventor: Robin Haynes, 1730 Industrial Dr., Auburn, Calif. 95603

[21] Appl. No.: 534,379

[22] Filed: Sep. 28, 1995

[51] Int. Cl.[6] ..... A47B 3/02

[52] U.S. Cl. ..... 108/116; 108/146; 108/130; 248/409

[58] Field of Search ..... 108/144.11, 146, 108/116, 126, 130, 143; 248/409, 188.6, 408; 403/109, 104, 105, 387; 52/645

[56] References Cited

U.S. PATENT DOCUMENTS

| | | | |
|---|---|---|---|
| 251,069 | 12/1881 | Shaw . | |
| 390,406 | 10/1888 | Sittig . | |
| 504,683 | 9/1893 | Peartree . | |
| 1,158,305 | 10/1915 | Schmeling . | |
| 1,184,455 | 5/1916 | Hough . | |
| 1,370,732 | 3/1921 | Corbett . | |
| 2,016,132 | 10/1935 | Bergslien | 248/409 |
| 2,205,869 | 6/1940 | Wakeman . | |
| 2,262,938 | 11/1941 | Howard . | |
| 2,378,852 | 6/1945 | James . | |
| 2,545,699 | 3/1951 | Johannsen . | |
| 2,622,353 | 12/1952 | Mendelson | 108/130 X |
| 2,643,922 | 6/1953 | Rudman . | |
| 2,702,222 | 2/1955 | Puls et al. . | |
| 2,831,739 | 4/1958 | Fryckholm . | |
| 3,217,672 | 11/1965 | Haughey | 108/146 |
| 3,309,050 | 3/1967 | Blink et al. | 108/146 |
| 3,410,232 | 11/1968 | Krueger . | |
| 3,589,757 | 6/1971 | Mooney | 248/188.5 X |
| 3,854,428 | 12/1974 | Fullenkamp . | |
| 3,915,102 | 10/1975 | Barron . | |
| 4,191,111 | 3/1980 | Emmert . | |
| 4,690,358 | 9/1987 | Horenkamp . | |
| 4,715,075 | 12/1987 | Shamie . | |
| 4,718,355 | 1/1988 | Hougton . | |
| 4,860,668 | 8/1989 | Baudenbacher . | |
| 5,009,170 | 4/1991 | Spehar . | |
| 5,107,775 | 4/1992 | Langlais et al. . | |

FOREIGN PATENT DOCUMENTS

| | | |
|---|---|---|
| 2609776 | 7/1988 | France . |

*Primary Examiner*—Jose V. Chen
*Assistant Examiner*—Janet M. Wilkens
*Attorney, Agent, or Firm*—Bernhard Kreten

[57] ABSTRACT

An adjustable length member, which can serve as a leg for an adjustable height table, is disclosed. A first channel of the adjustable length member contains a rack mechanism on the inside surface while the internesting second channel contains a pawl, which is brought out of engagement with the rack by a wire attached to a handle under the table top to pivot the pawl. A spring biases the pawl back into engagement with a tooth of the rack mechanism when the wire applies no force to the pawl.

19 Claims, 5 Drawing Sheets

ADJUSTABLE LENGTH TABLE LEG FOR A MASSAGE TABLE

FIELD OF THE INVENTION

The present invention relates to an adjustable length member, especially a member with internesting channels, which can serve as adjustable legs on a table which can be adjusted in height.

BACKGROUND OF THE INVENTION

Adjustable length members have a variety of uses, but a frequent use is as table legs. Tables, such as massage tables, often need to be adjusted in height from the floor to accommodate different personnel who are of varying heights. Sometimes the table needs to be disposed at a slant and thus the legs at one end need to be adjusted to a shorter length. Tables with adjustable heights can also find use as work benches, portable display tables, auxiliary kitchen counters, or any number of other similar uses.

The mechanism that permits the adjustment of table leg length can take many forms. Often two members were interlocked and were held in position by placing a pin through holes in both members which lined up at certain discreet heights. When such a pin and complementary holes were used, two hands are required to adjust one leg. Sliding members have had the disadvantage of allowing lateral movement of the components, causing the table or device supported by such legs to be less stable.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 251,069 | December 20, 1881 | Shaw |
| 390,406 | October 2, 1888 | Sittig |
| 504,683 | September 5, 1893 | Peartree |
| 1,158,305 | October 26, 1915 | Schmeling |
| 1,184,455 | May 23, 1916 | Hough |
| 1,370,732 | March 8, 1921 | Corbett |
| 2,205,869 | June 25, 1940 | Wakeman |
| 2,262,938 | November 18, 1941 | Howard |
| 2,378,852 | June 19, 1945 | James |
| 2,545,699 | March 20, 1951 | Johannesen |
| 2,643,922 | June 30, 1953 | Rudman |
| 2,702,222 | February 15, 1955 | Puls et al. |
| 2,831,739 | April 22, 1958 | Fryckholm |
| 3,410,232 | November 12, 1968 | Krueger |
| 3,854,428 | December 17, 1974 | Fullenkamp |
| 3,915,102 | October 28, 1975 | Barron |
| 4,191,111 | March 4, 1980 | Emmert |
| 4,690,358 | September 1, 1987 | Horenkamp |
| 4,715,075 | December 29, 1987 | Shamie |
| 4,718,355 | January 12, 1988 | Houghton |
| 4,860,668 | August 29, 1989 | Baudenbacher |
| 5,107,775 | April 28, 1992 | Langlais et al. |
| DE 546,178 | | |
| FR 2,609,776 | July 22, 1988 | Malbrunot |

Among the above patents, four show a pawl and rack mechanism to control adjustment of height for the table leg. U.S. Pat. Nos. 1,184,455; 1,370,732; 3,854,428 and FR 2,609,776 all show a pawl mechanism engaging the teeth of a rack mounted within one of two slideably engaged leg members. However, none of the four patents mentioned, shows a mechanism wherein the engagement of the pawl will bias the two leg members together. The shape of the internesting leg components is adapted to provide for slideable engagement. Locking of the leg components at a particular height is caused by the pawl forcing the two leg components together. The other prior art listed above, but not specifically discussed, teach other devices for adjustable length members and further catalog the prior art of which the applicant is aware. These references diverge even more starkly from the references specifically distinguished above.

SUMMARY OF THE INVENTION

The adjustable length member of this invention provides an easily operated mechanism for adjusting the length of a member which can serve as a table leg for a height adjustable table. When the linkage between the multiple sections of the elongate rod is a rack and pawl assembly, the pawl can be activated by a wire pulled by a handle disposed underneath the table top. In general, the multiple sections of the adjustable length member comprise a rack attached to a first channel including teeth on the inside surface thereof and a pawl pivotally connected to a second channel, the other channel constrained to remain adjacent to the rack and allow the pawl to releasably engage the teeth of the rack. The multiple sections can be channels wherein the first channel has inwardly converging walls and the second channel has outwardly diverging walls such that the two channels internest. The pawl means which is disposed within one of the channels is adapted to engage the teeth of a rack means on the inside of the other channel. When compressive force is applied to the adjustable length member, the pawl means pressures the second channel against the first channel. The adjustable length members can serve as legs for a height adjustable table. A wire, connected to a handle underneath the top table at one end and the pawl at the other end, serves as a pawl release mechanism. When the handle is activated, pulling the wire which pulls the pawl out of engagement with the teeth of a rack, the height of the leg can then be adjusted by one person using one hand. A spring means would bias the pawl mechanism into engagement with the teeth of the rack means when the proper height is reached by the table leg. To lengthen the member, the pawl can move in a ratcheting fashion if it is pulled upwards because the pawl can slide over teeth set at an inclined angle. Downward pull movement is prevented by engagement with the teeth. Finally, the pawl means can be mounted on a bushing means which spaces the two channels, especially internesting channels, apart from each other the width of the bushing. The engagement resulting from the channels being further pressed together laterally stabilizes the adjustable length member when it is under load.

OBJECTS OF THE INVENTION

It is, therefore, an object of the present invention to provide a height adjustable table with legs comprised of legs having a first portion and second portion and means to adjust interrelationships of the first and second portions.

It is another object of the present invention to provide a rack and pawl linkage between adjustable sections of a adjustable length table leg.

Viewed from the first vantage point, it is an object of the present invention to provide an adjustable length member comprising a first channel; a second channel having means to internest within the first channel, and means to move in changing longitudinal interrelationship with the first channel; a rack of projecting teeth disposed longitudinally on inside surface of first channel; a pawl means attached to the second channel having biasing means toward engagement with the rack; and a pawl release means adapted to disengage the pawl means from an engaged tooth of the rack when activated, the biasing means allowing the pawl to reengage the rack when the release means is not activated; the pawl adapted to force the second channel against the first channel when engaged.

Viewed from a second vantage point, it is an object of the present invention to provide a portable massage table comprising in combination: a top table surface having first and second panels hinged to each other at latitudinal registering edges to allow folding about the registering edges, a bottom table surface having two pairs of corners, one pair per panel and located at latitudinal edges remote from the hinge, one leg pivotably disposed at each corner, each leg including bracing means extending from the underside of the panel to the leg, each pair of legs interconnected by a strut so that the pair of legs folds together against the underside, and each leg having a leg head and a leg foot, the leg head having a channel, the leg foot having a channel, the channels having means to interconnect the leg head and leg foot.

Viewed from a third vantage point, it is an object of the present invention to provide a portable massage table comprising in combination: a top table surface having first and second panels hinged to each other at latitudinal registering edges to allow folding about the registering edges, a bottom table surface having two pairs of corners, one pair per panel and located at a latitudinal edge remote from the hinge, one leg pivotably disposed at each corner, each leg including bracing means extending from the underside of the panel to the leg, each pair of legs interconnected by a strut so that they fold together against the underside, each leg having a leg head and a leg foot, the leg head having a channel, the leg foot having a channel, the channels having means to interconnect the leg head and leg foot, the channel interconnecting means includes a rack on one channel and a pawl on the other channel, one channel having diverging sidewalls, the other channel having converging sidewalls, the sidewalls nested over one channel sidewall oriented to move parallel, a spring biasing the pawl into engagement with one tooth of the rack, and a pawl release mechanism extending from the pawl to the underside of the table.

These and other objects will be made manifest when considering the following detailed specification when taken in conjunction with the appended drawing figures.

DESCRIPTION OF PREFERRED EMBODIMENTS

Figure 1:
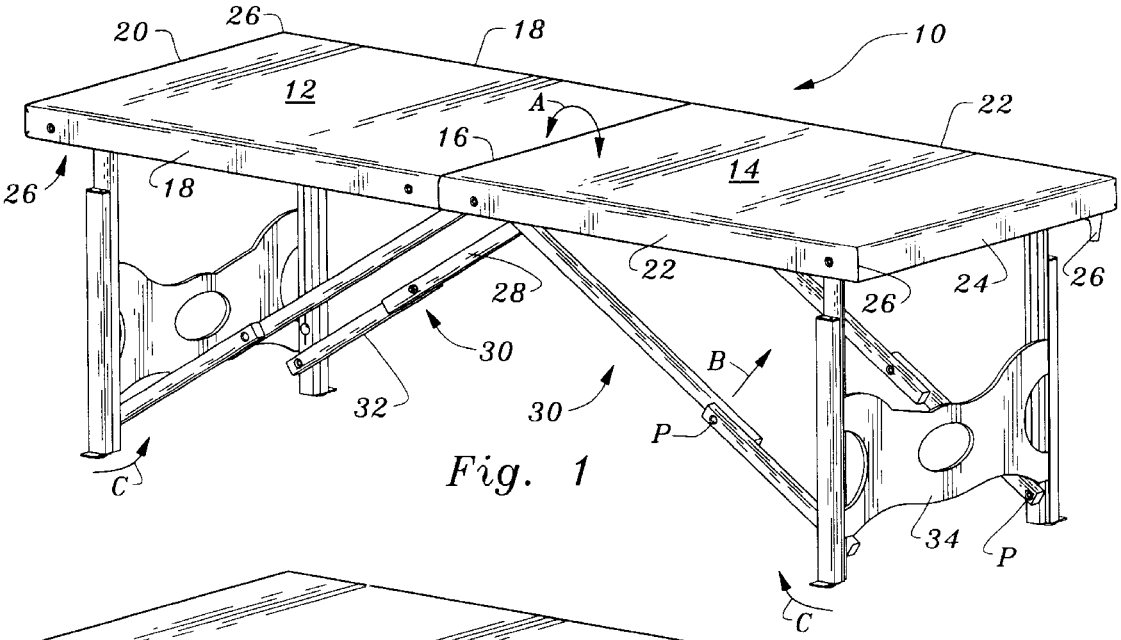
FIG. 1 is a perspective view of a height adjustable table.

Considering the drawings, wherein like reference numerals denote like parts, reference numeral 10 is directed to the massage table according to the present invention.

Figure 2:
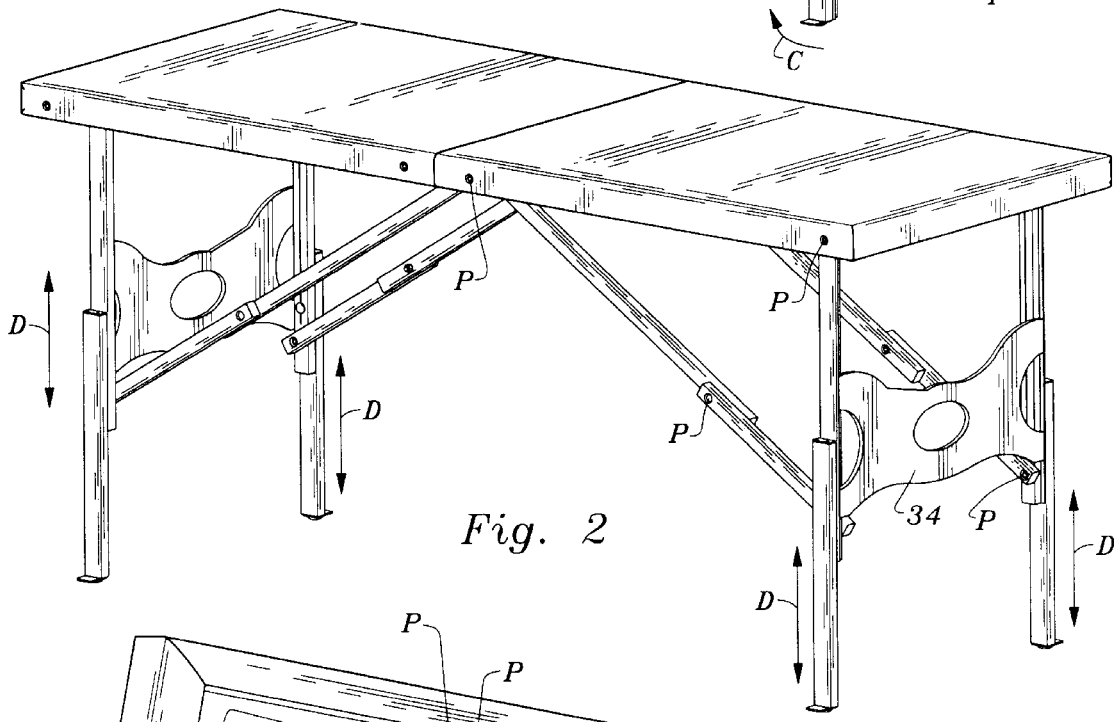
FIG. 2 is a perspective view of a height adjustable table set at a higher level than in FIG. 1.

In essence, the massage table 10 is formed from two panels 12, 14 separated one from the other and connected thereto by a hinge 16 to allow rotation of the table about the hinge line 16 about arrow A running transverse to a long axis of the table 10. FIG. 1 shows top surfaces of the two panels 12, 14 which are to be placed in facing relationship when the table is folded along the hinge line 16. The two panels also include peripheral walls extending down from the panels and which circumscribe the three non-hinge sides of the panels. Specifically, the peripherally extending down wall 18 circumscribes two longitudinal aspects of panel 12 and down wall 20 finishes an end of the peripheral rim remote from panel 14. Similarly, the panel 14 has longitudinally extending down walls 22 and an end down wall 24 parallel to the end down wall 20 on an opposite end of the table. Collectively the two panels define an elongate rectangular support surface upon which a person is to lie for the massage. Corners 26 at extremities of the table 10 include downwardly extending legs held in a rigid vertical position with respect to a planar surface of the two panels 12, 14 by means of braces 30, one of which extends to each leg and terminates adjacent the hinge line 16 on an underside of the table 10. Each of the braces has an upper link 28 and a lower link 32. The links are interconnected by means of pivots P at their juncture, with sufficient overlap so that when extended, they provide a two piece brace having a parallel long axis. The links are adapted to move in the direction of the arrow B for folding when the legs move about the arrow C for folding and storage. As mentioned, four legs are located in pairs, one pair adjacent each latitudinal edge adjacent the corners 26. The pairs of legs are interconnected by means of a transverse strut 34 which interconnects one pair of legs. FIGS. 1 and 2 reflect the difference in elevation when the legs are extended along their long axis about arrow D. The legs and braces are also shown with pivots (occluded normally) shown diagramatically in FIG. 2 to locate the pivot points of both the legs and the braces to allow folding. The mechanism by which the legs can move along the double ended arrow D can now be explored.

Figure 3:
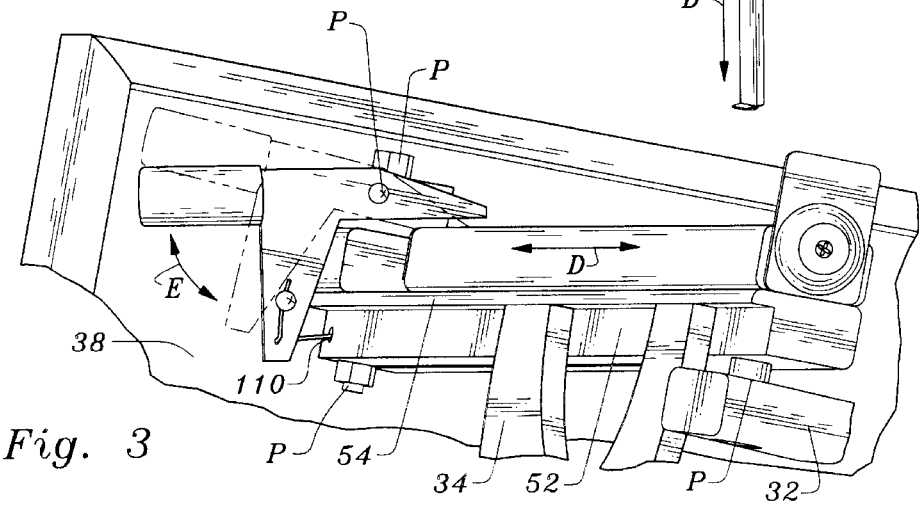
FIG. 3 is a perspective view from the bottom of the table leg mechanism showing the movement of the handle which pulls the wire in the direction of adjustment of the able leg.
Figure 4:
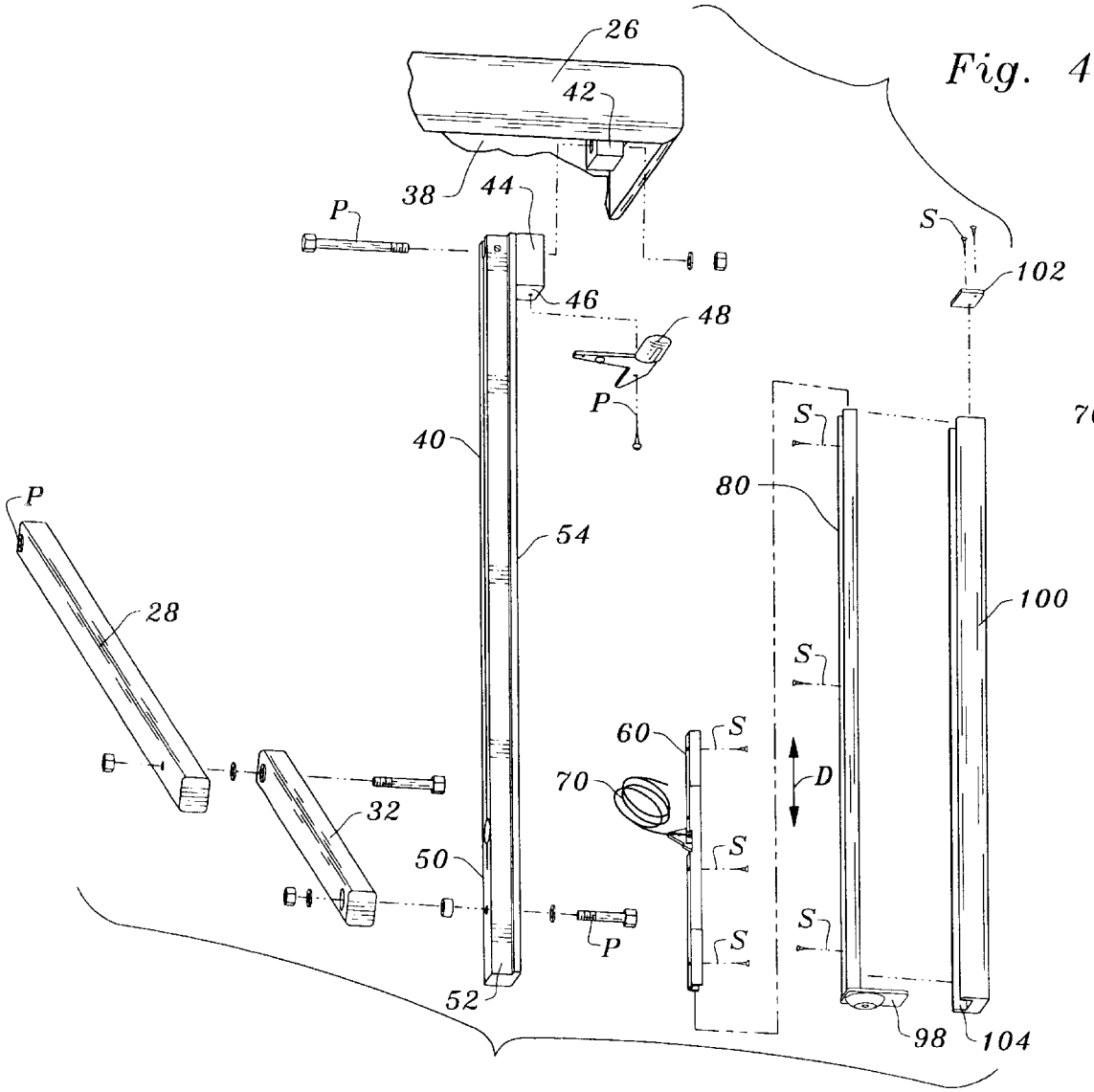
FIG. 4 is an exploded parts view of the table leg.

As shown in FIG. 4, the longitudinally extensible table leg has four major components: a table head 40, a table foot 100, a pawl carrying channel 60 attached to the table head 40, and a rack carrying channel 80 attached to the table foot. The pawl channel is dimensioned to nest and slide within the rack channel 80 as indicated by the dotted line in FIG. 4. In this manner, relative motion along the double ended arrow D is possible as will now be further defined. The table head 40 nearest an underside 38 of the table connects via a pivot P which passes through a block 42. The head 40 has a supporting block 44 to provide additional support for the pivot P. Block 44 also has a bottom face 46 which supports a trip mechanism 48 which is substantially T-shaped. The trip 48 is pivotally connected to the bottom face 46 via pivot P located on one of three tangs. Another tang of the trip 48 supports a cable 70 which runs to the pawl channel for releasably engaging the pawl as will be described. A third tang of the trip is a grasping lever arm that allows motion about the arrow E of FIG. 3.

The table head 40 has a relieved area 52 which allows the strut 34 to be located therein. Otherwise, the table head 40 is substantially rectangular. With the relieved area 52, however, the rectangular head has a lip 54 located adjacent the table foot for additional bearing surface support thereagainst.

Figure 5:
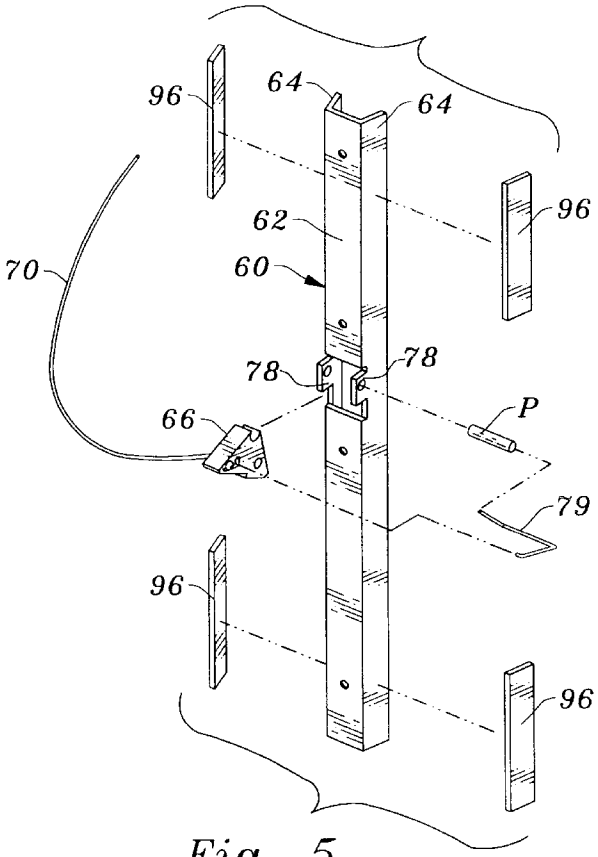
FIG. 5 is an exploded parts view of one channel with the pawl and pushing mechanism shown.
Figure 10:
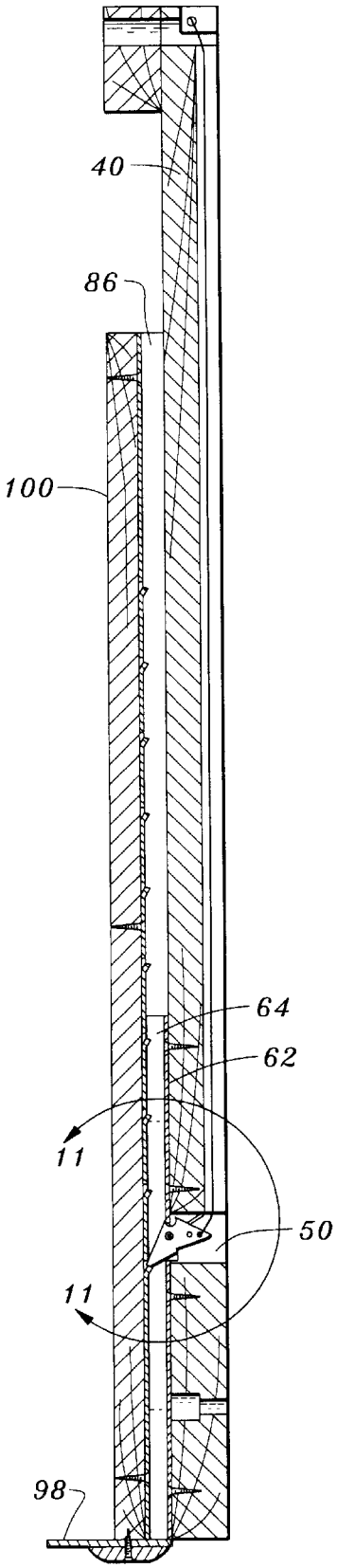
FIG. 10 is a vertical cross-section of the table leg as mounted to the tabletop.
Figure 11:
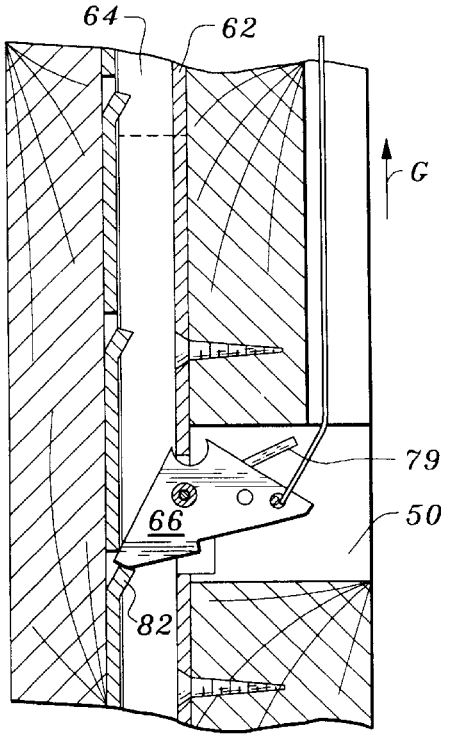
FIG. 11 is a detailed cross-section of the table leg with the pawl mechanism engaging a tooth of the rack.
Figure 12:
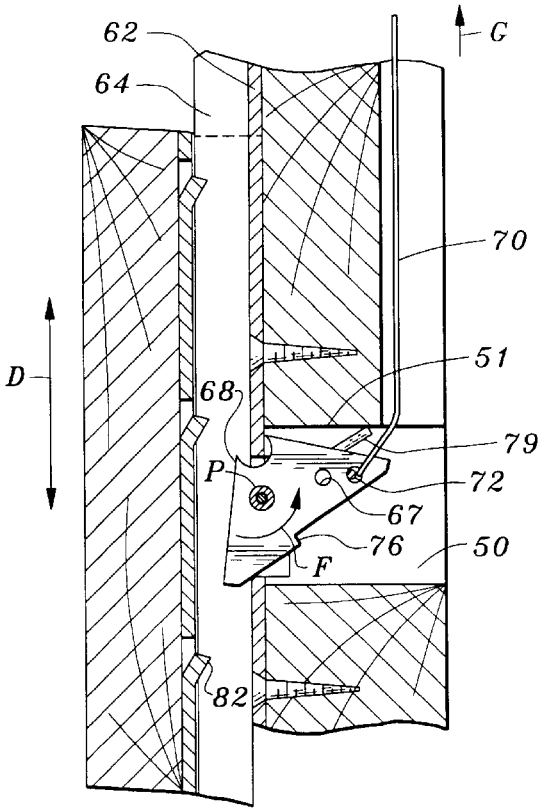
FIG. 12 is a detailed cross-section of FIG. 10 wherein the pawl mechanism has moved out of engagement with the teeth of the rack.
Figure 13:
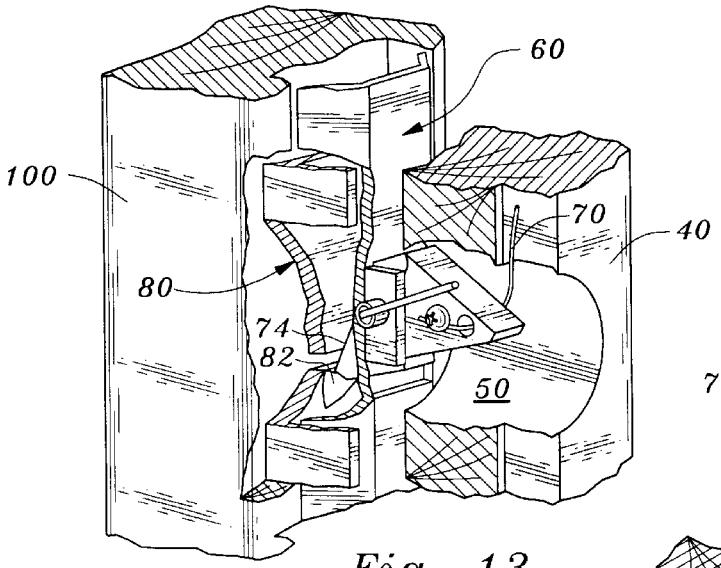
FIG. 13 is a cut-away drawing of the table leg showing the pawl mounting.
Figure 14:
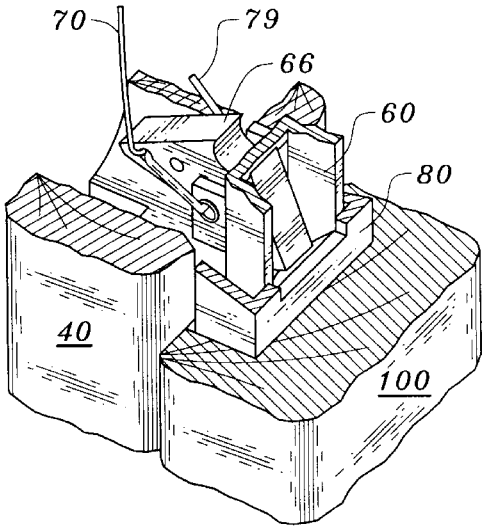
FIG. 14 is a further cut-away drawing of the table leg showing the pawl engaging the rack.

As shown in FIG. 4, the pawl carried channel 60 is screwed to the table head 40 by a plurality of screws S. The channel (shown in FIG. 5) has a bight portion 62 and a pair of outwardly diverging walls 64 defining a structure which is substantially U-shaped in cross-section. Clearance for the pawl 66 is provided by a hole 50 located in the table head 40 (FIGS. 4 and 10 through 12). The pawl 66 is substantially triangular in shape when viewed from a side (e.g. FIGS. 11, 12 and 15) and includes one apex of the triangle removed to permit arcuate movement about the bight portion 62. The removed apex 68 as it abuts the bight portion 62 can provide a positive stop as the pawl 66 moves about the arrow F and responds to urging from a cable 70 that extends to the trip 48. When the trip 48 is moved about the arrow E of FIG. 3, the cable 70 moves about the arrow G of FIG. 12 in response to rotation of the pawl 66 about pivot P of FIG. 12. An end of the cable 70 remote from the trip is attached adjacent another apex 72 of the pawl. The remaining apex 74 of the pawl 66 includes a contact area for the rack 80. More specifically, and viewing FIGS. 11 and 12 the pawl 66 has its remaining apex 74 truncated so that (FIG. 11) when engaging a tooth on the rack 80, the two surfaces will be in substantial tangential registry. The base of the pawl 66 that extends from the truncated apex 74 and the apex 72 which carries the cable 70 has a step-down portion 76 for clearance when installing the pawl 66 and allow accommodation for the arcuate cutaway 68*a* in apex 68. The installation of the pawl 66 can occur from a side of the channel opposite that which is shown in FIG. 5. The two ears 78, formed on the channel 60 on a face thereof remote from the direction of channel divergence, support the pawl via a pivot P. The pivot P is hollow and allows a spring 79 to pass therethrough. The spring has one free end which abuts against a top wall 51 of the hollow 50 (FIG. 12). A second free end of the spring 79 nests within a hole 67 formed in the pawl. Please see FIG. 8. Normally, the pawl is biased as shown in FIG. 11 by the presence of the spring 79. Force along the direction of the arrow G (FIG. 12) displaces the pawl as shown in FIG. 12 releasing the flattened apex 74 of the pawl away from the corresponding tooth 82 of the rack. This allows motion along the double ended arrow D of FIG. 12.

Figure 8:
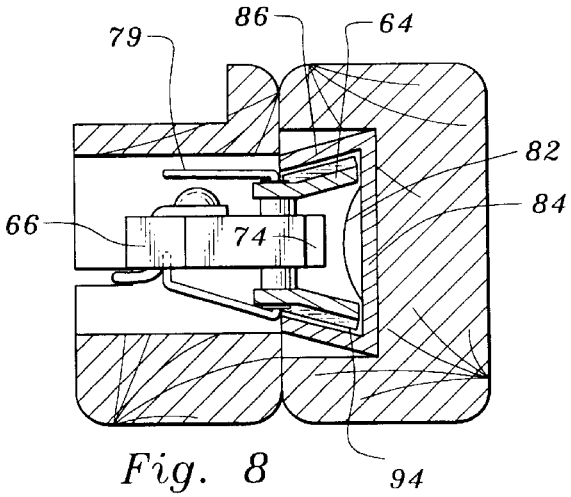
FIG. 8 is a horizontal cross-section of the table leg at the point where the pawl mechanism out of engagement with the rack.

Referring back to FIG. 4, as mentioned, the pawl channel 60 is fixed to the table head 40 by screws. In addition, however, the pawl channel has a dimension which allows it to be nested and telescoped within the rack channel 80 as shown by the dotted line of FIG. 4 and as further detailed in FIG. 8. The rack channel 80 accordingly is substantially U-shaped and includes a bight portion 84 upon which a plurality of curved teeth 82 are punched that extend towards the pawl 66. The U-shaped channel way also includes first and second legs 86 which converge inwardly substantially parallel to the outwardly diverging legs 64 of the pawl channel. As shown in FIGS. 4 and 10, the rack channel 80 is substantially longer than the pawl channel 60. A lower portion of the rack channel 80 includes a tab 98 adapted to abut against a bottom surface of the table foot 100, serving as a stop. The tab 98 also extends beyond the table foot 100 and provides a purchase area where one's shoe can be placed to assist in moving the table foot 100 relative to the table head 40. When such motion is effected, the trip 48 is first engaged to remove the pawl from the rack and then the pawl channel and rack channel can move relative to each other. If the only adjustment desired is to lengthen the member 10, the trip 48 need not be activated since the pawl 66 may ratchet by the teeth 82. As mentioned, the two channels are complemental and allow one to slide within the other, preferably the pawl channel within the rack channel. In order to maximize the ease with which the pawl channel and rack channel can slide relative to one another, an upper and lower pair of low friction shims 96 are fixed to the pawl channel on the outer diverging surfaces of the legs 64. These shims 96 provide for quieter adjustment of the length of the legs. As shown in FIG. 8, when the pawl 66 is released from the rack tooth 82 a clearance 94 (shown in an exaggerated dimension for illustration purposes, sometimes there is only a slack fitting and not any actual open space) exists which allows vertical motion relative to the two. When the pawl 66 is engaged with tooth 82, the table is stable and locked and the pawl 66 rides against the tooth 82 in a secure manner with the shims 96 tightly interposed between the legs 64 of the pawl channel and legs 86 of the rack channel. Referring to FIGS. 4 and 10 again, it is shown that the rack channel 80 is attached to the table foot 100 by a plurality of screws S. Thus, it should be clear that the table foot 100 has a substantially U-shaped contour in section to accommodate the rack channel 80 as shown in FIG. 8 for example.

Figure 6:
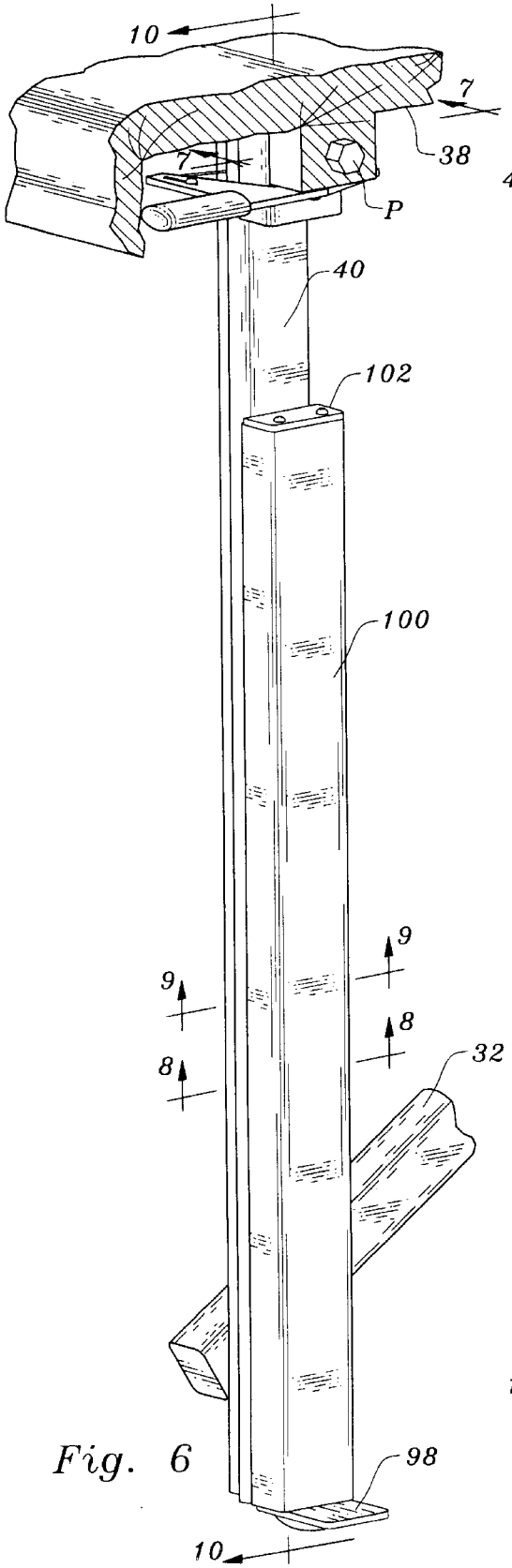
FIG. 6 is a perspective view of a table leg mounted to the underneath of the table top.

FIG. 6 reflects that in addition to the tab 98 sealing a bottom of the U-shaped channel, the rack channel 80 includes a top cap 102. This top cap attaches to an end of the table foot 100 to occlude the U-shaped opening 104 that allows the rack channel 80 to be nested therewithin.

Figure 7:
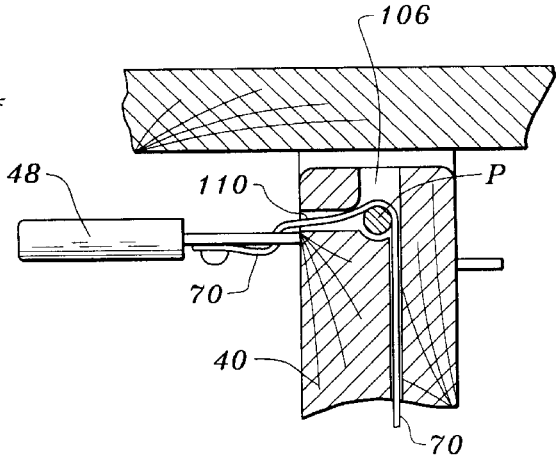
FIG. 7 is vertical cross-section of the top of the table leg mounted to the underside of the tabletop.
Figure 9:
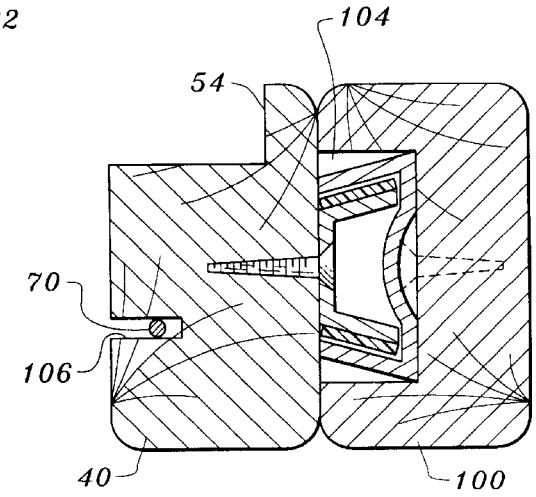
FIG. 9 is horizontal cross-section of the table leg above the pawl mechanism.

With respect to FIGS. 7 and 9, details of the chase 106 within which the cable 70 is housed can be explored. As shown, in FIG. 9 the cable 70 has access to a chase like slit 106 extending along the length of the table head 40. As it approaches the top of the table head 40, it moves into a blind bore and moves over pivot P to be connected to the trip 48 as described infra with respect to FIGS. 3 and 4. Accordingly, a bore 110 passes the cable 70 out a lateral aspect of the table head 40.

Figure 15:
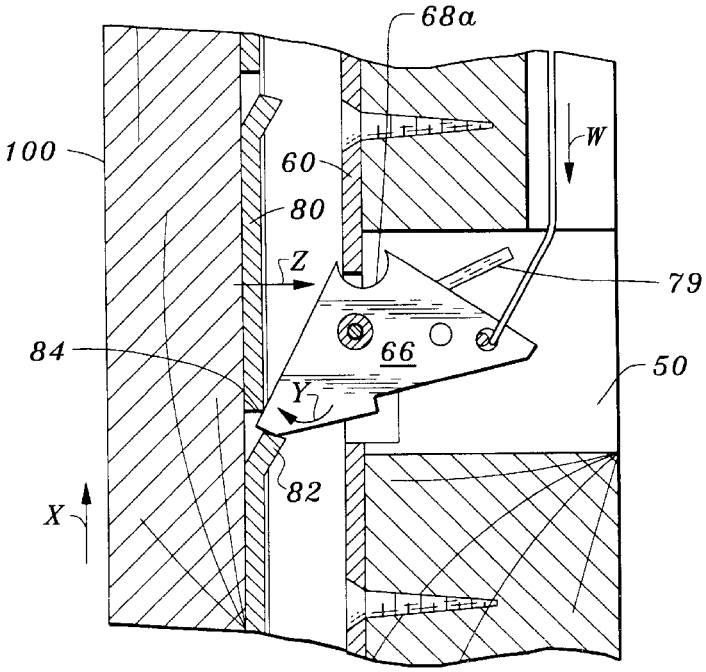
FIG. 15 is a force vector diagram for the pawl experiencing load force from the table top.

Referring now to FIG. 15, the force vectors operating to laterally stabilize the table leg under load are illustrated. The cross-section of the leg in FIG. 11 around the pawl 66 has been enlarged. Force vector arrow W representing the force generated by any weight on the table 10, or even the weight of the table itself, urges pawl carrying channel 60 and the pawl 66 itself downwards. Tooth 82 attached to rack carrying channel 80, which is attached to table foot 100 that stands on the floor, resists the downward movement of pawl 66 in the direction of force vector X. The tooth 82 resistance causes a clockwise pivoting force Y to arise in pawl 66. However, pivoting force Y is resisted by the presence of bight 84 which induces force vector Z which pushes pawl 66 and pawl carrying channel 60 away from rack carrying channel 80. In FIG. 8, force vector Z would then close any gap 94 or slackness in contact between the channels, pressuring the engagement of pawl carrying channel 60 and rack carrying channel 80. This further pressurized engagement leads to increased lateral stability of the table leg.

In use and operation, the table 10 is first unfolded about arrow A so that the facing top surfaces of panels 12 and 14 no longer face each other but combine to form an elongate rectangular plane interconnected one to another by means of a hinge 16. Next, legs are deployed by rotating them in the direction opposite from the arrows C shown in FIG. 1. This causes the transverse braces and their upper links and lower links 28 and 32 to move in a direction opposite from arrow B shown in FIG. 1. When they have achieved a locked position such that each link shares a common parallel long axis, as shown in FIG. 2, the table can be oriented in an upright position so that the legs and their tabs 98 address the ground. The relationship between the table head 40 and the table foot 100 can now be adjusted by means of manipulating the trip and constraining the tab 98 using one's shoe and pulling the table up and down along the direction of the double ended arrow D to adjust the height. As mentioned infra, manipulation of the trip 48 manipulates the pawl 66 so that when the spring 79 of the pawl has been overcome by the cable 70 and trip 48, the table is capable of being adjusted along the direction of the double ended arrow D by means of sliding along the anti-friction shims 96. However, once the trip has been released, the force of the spring tension 79 against a top wall 51 of the bore 50 forces the pawl to rotate opposite from the direction of the arrow F in FIG. 12 catching upon a tooth 82 on the rack. As shown in FIG. 15, a downward load forces results in pressure between surfaces 86 and 84, compressing bushing 94 which results in a laterally stable structure under load. The compression of the channels and the shims provides a bracing and biasing that provides an extremely stable structure. Note that the clearance 94 has been exaggerated for purposes of clarity, but the important point is that the majority of the time contact exists between the friction shims 96 and inside walls of channel 80, even when pawl 66 is disengaged, but it is the pressure of the contact that differs from between times the pawl is and is not engaged.

Moreover, having thus described the invention, it should be apparent that numerous structural modifications and adaptations may be resorted to without departing from the scope and fair meaning of the instant invention as set forth hereinabove and as defined hereinbelow by the claims.

I claim:

1. An adjustable length leg on a table, the leg comprising:

a first channel;

a second channel having means to internest within said first channel, and means to move in changing longitudinal interrelationship with said first channel;

wherein said first channel has inwardly converging walls and said second channel has outwardly diverging walls adapted to internest with inside surfaces of said inwardly converging walls of said first channel;

wherein a bushing means is attached to outside surfaces of said outwardly diverging walls of said second channel;

a rack of projecting teeth disposed longitudinally on an inside surface of first channel;

a pawl means attached to said second channel having biasing means toward engagement with said rack; and a pawl release means adapted to disengage said pawl means from an engaged tooth of said rack when activating said biasing means thereby allowing said pawl means to reengage said rack when said release means is not activated;

said pawl means including means to force said second channel against said first channel when engaged.

2. The adjustable length leg of claim 1 including at tab on a lower terminus of said leg remote from the table to be engaged by a toe of a person to elevate the table, while lifting the table upward.

3. The adjustable length leg of claim 2 wherein said pawl means has two positions, a first disengaged position allowing said first and said second channels to align in parallel relationship to each other, and a second engaged position whereby any downward load imposed on the table is at least partially translated into said force means further pressing said second channel into said first channel.

4. The adjustable length leg of claim 3 wherein the table is a massage table and said leg is attached to said massage table wherein said massage table has two panels defining a bottom surface interconnected by a hinge medially and transversely disposed along a length of the table.

5. The adjustable length leg of claim 4 wherein one of said channels is pivotally attached to said massage table and wherein said leg includes a pivot to move into parallel abutting relationship with said bottom surface of said massage table.

6. The adjustable length leg of claim 5 wherein said pawl release means is a wire that when activated pulls said pawl means out of engagement with one of said teeth, and which is paired against said biasing means which is a spring acting to bias said pawl means into position to engage said rack.

7. The adjustable length leg of claim 6 wherein said wire is attached to a pivoting handle disposed on said bottom surface of said massage table.

8. The adjustable length leg of claim 7 wherein said pawl has a substantially triangular shape with three apices:

a first apex having an arcuate cutaway, a second apex having a truncated terminal portion for registry with said rack teeth, and a third apex provided with a hole coupled to said wire.

9. The adjustable length leg of claim 8 wherein said pawl means pivots about a point, and said spring passes through said pivot, said spring having a first end contacting an interior wall of a bore which receives said pawl means and a second end captured by a said pawl means.

10. The adjustable length of claim 9 wherein said first channel is fixed within a U-shaped recess of an elongate table foot and said second channel is fixed on an elongate table head, said table foot and table head juxtaposed tangentially one to the other, said second channel slideably disposed within said first channel such that said table foot and table head move along their respective longitudinal axes in spaced parallel relationship.

11. The adjustable leg of claim 10 wherein four said legs depend from four corners of said massage table, two pairs of legs at each opposed latitudinal extremity parallel to said hinge.

12. The adjustable length legs of claim 11 wherein each said pair of legs includes an interconnecting strut so that said pairs of legs pivot under the table together.

13. The adjustable length legs of claim 12 wherein each said leg has its own trip mechanism to independently adjust its length.

14. The adjustable length legs of claim 13 wherein a brace extends between each said leg and an underside of said table.

15. The adjustable length legs of claim 14 wherein said brace has at least two links:

an upper link having an end pivoted to said bottom surface of said massage table and a lower link having an end pivoted to said legs, said upper and lower links pivoted to each other at their other ends including overlap thereat.

16. A portable massage table comprising in combination:

a table having top and bottom surfaces said table formed from first and second panels hinged to each other at latitudinal registering edges to allow folding about said registering edges, said bottom table surface having two pairs of comers, one pair per said panel and located at latitudinal edges remote from said hinge, one leg pivotably disposed at each said corner, each said leg including bracing means extending from said bottom surface of said panels to said legs, pairs of said legs are interconnected by a strut so that each said pair of legs folds together against said bottom, and each said leg having a leg head and a leg foot, said leg head having a channel, said leg foot having a channel, said channels having means to interconnect said leg head and leg foot such that said head and foot travel side-by-side in tangential non-telescopic abutting registry, wherein said channel interconnecting means includes a rack on one said channel and a pawl on the other said channel, one said channel having diverging sidewalls, the other said channel having converging sidewalls nested over said one channel diverging sidewalls, said sidewalls oriented to move parallel with respect to each other.

17. The table of claim 16 wherein said pawl has biasing means for engaging said pawl with said rack.

18. A portable massage table comprising in combination:

a table having top and bottom surfaces, said top table surface having first and second panels hinged to each other at latitudinal registering edges to allow folding about said registering edges, said bottom table surface having two pairs of corners, one pair per said panel and located at a latitudinal edge remote from said hinge, one leg pivotably disposed at each said corner, each said leg including bracing means extending from said bottom surface to said legs, pairs of said legs are interconnected by a strut so that they fold together against said bottom surface, each said leg having a leg head and a leg foot, said leg head having a channel, said leg foot having a channel, said channels having means to interconnect said leg head and leg foot, said channel interconnecting means includes a rack having teeth on one said channel and a pawl on the other said channel, one said channel having diverging sidewalls, the other said channel having converging sidewalls nested over said one channel diverging sidewalls said sidewalls oriented to move parallel with respect to each other, a spring biasing said pawl into engagement with one tooth of said rack, and a pawl release mechanism extending from said pawl to said bottom surface of said table.

19. The table of claim 18 wherein said pawl passes through an opening on said other channel and is fixed thereto via a pivot, said pivot having one truncated apex, each said tooth on said rack having a pawl engaging surface tangential to said truncated apex.

* * * * *